US007588210B2

(12) United States Patent
Häfner

(10) Patent No.: US 7,588,210 B2
(45) **Date of Patent: *Sep. 15, 2009**

(54) SPOOL FOR RECEIVING A WOUND SKEIN MATERIAL

(75) Inventor: Manfred Häfner, Leopoldshöhe (DE)

(73) Assignee: Häfner & Krullmann GmbH, Leopolodshöhe (DE)

( * ) Notice: Subject to any disclaimer, the term of this patent is extended or adjusted under 35 U.S.C. 154(b) by 51 days.

This patent is subject to a terminal disclaimer.

(21) Appl. No.: 11/908,126

(22) PCT Filed: Mar. 8, 2006

(86) PCT No.: PCT/EP2006/002135

§ 371 (c)(1),
(2), (4) Date: Sep. 8, 2007

(87) PCT Pub. No.: WO2006/094787

PCT Pub. Date: Sep. 14, 2006

(65) Prior Publication Data

US 2008/0230648 A1 Sep. 25, 2008

(30) Foreign Application Priority Data

Mar. 9, 2005 (DE) ..... 10 2005 010 710

(51) Int. Cl.
*B65H 75/14* (2006.01)

(52) U.S. Cl. ..... 242/609; 242/609.1; 242/609.3; 242/118.4

(58) Field of Classification Search ..... 242/609, 242/609.1, 609.3, 118.4, 118.61
See application file for complete search history.

(56) References Cited

U.S. PATENT DOCUMENTS 3,796,387 A * 3/1974 Zielke ..... 242/606

(Continued)

FOREIGN PATENT DOCUMENTS

| | | |
|---|---|---|
| DE | 40 01 250 A1 | 7/1991 |
| DE | 42 36 486 A1 | 5/1994 |
| DE | 197 00 185 A1 | 7/1998 |

(Continued)

*Primary Examiner*—Sang Kim
(74) *Attorney, Agent, or Firm*—Richard M. Goldberg

(57) ABSTRACT

Spool for receiving a wound skein product includes a rotationally symmetrical spool body, with two axial ends provided with flange discs (16, 18), the spool being divided into two parts (10, 12) by a substantially radial dividing surface, these parts having front surfaces (36, 38) running adjacent and parallel to the dividing surface (14), the front surfaces having locking projections (48, 50) on at least one surface and, on the other surface at least, detent recesses (40, 42) which interact with the locking projections of the other spool part (10, 12), respectively, interlocking therewith in the form of a bayonet catch by mutual rotation of spool parts (10, 12), and the front surfaces (36, 38) are contrived such that the dividing line appearing around the spool circumference is wave-shaped.

11 Claims, 4 Drawing Sheets

U.S. PATENT DOCUMENTS

| | | | | | |
|---|---|---|---|---|---|
| 5,593,108 | A | * | 1/1997 | Eck et al. | 242/608.5 |
| 5,779,186 | A | * | 7/1998 | Bakker et al. | 242/609.1 |
| 5,803,401 | A | * | 9/1998 | Matsuzoe | 242/608.5 |
| 6,089,500 | A | * | 7/2000 | Hafner | 242/608.5 |
| 6,343,765 | B1 | * | 2/2002 | Wen | 242/609.1 |
| 2007/0181739 | A1 | * | 8/2007 | Derendal | 242/608.5 |
| 2007/0262192 | A1 | * | 11/2007 | Derendal | 242/608.5 |

FOREIGN PATENT DOCUMENTS

| | | | | |
|---|---|---|---|---|
| DE | 100 25 730 | A1 | | 12/2001 |
| EP | 0 404 043 | A1 | | 12/1990 |
| JP | 11 228030 | A | | 8/1999 |
| WO | 02/08107 | | * | 1/2002 |
| WO | WO 03/042084 | A1 | | 5/2003 |

* cited by examiner

SPOOL FOR RECEIVING A WOUND SKEIN MATERIAL

BACKGROUND OF THE INVENTION

The invention relates to a spool for receiving a wound skein product comprising a rotationally symmetrical spool body with two axial ends provided with flange discs, said spool being divided into two parts by a substantially radial dividing surface, these parts having front surfaces running adjacent and parallel to the dividing surface, said front surfaces having locking projections on at least one surface and, on the other surface at least, detent recesses which interact with the locking projections of the other spool part respectively, interlocking therewith in the form of a bayonet catch by mutual rotation of the spool parts.

A spool of this type is disclosed in EP 404 043 A1, for example. DE 197 00 185 illustrates a similar solution.

In the case of these prior art spools, the spool parts taper conically towards the dividing surface. The advantage of the divisibility of the spools in connection with this conical tapering of the spool parts is that, once the skein product has been unwound, the spools can be taken apart and, thanks to their conical shape, stacked, so that they require little space during transport and storage.

But whilst the divisibility of the spools is associated with considerable advantages, it presents disadvantages in certain places. As, for example, when spools are used to wind very fine skein materials such as thin wires without insulation. These fine skein materials can slip into the gap between the two spool parts and become so firmly lodged that when the material is unwound, they remain in the gap and snap apart. This can hinder the process of unwinding the skein material and further necessitates additional work, as it is essential to remove any remaining skein material before reusing the spool.

Furthermore, experience has shown that it is impossible to press the two spool parts, which are usually made of plastic, so tightly together as to eliminate virtually any gap between them. This is true even where suitable sloping surfaces are provided in the bayonet connection used to join up the spool parts, or where thread-type structures are used to press the parts together (DE 40 01 250 A1).

SUMMARY OF THE INVENTION

The invention is therefore based on the task of providing a spool of the aforementioned type, where the gap between the spool parts is designed such that even very fine skein materials cannot slip into the gap.

This task is solved in that the spool of the above type is characterised in that the front surfaces are contrived such that the dividing line appearing around the spool circumference is wave-shaped.

As the skein material is always wound onto the spools of the type in question here in the circumferential direction, it cannot follow the wave-shaped path of the dividing line between the spool halves, and cannot therefore slip into the gap in any position.

Experience has shown that even a relatively flat wave shape such as a sinus line, for example, is sufficient to achieve the desired result. Experience has also shown that the spool parts of a spool with a wave-shaped dividing line can still be connected with connecting means based on the principle of a bayonet catch in spite of plausible initial reservations with respect to the possibility of the wave shape hindering the mutual rotation of the spool parts during connection. During the connection process, the two spool parts should initially be brought together with two wave peaks positioned opposite each other, and then rotated until the wave peaks engage with the wave troughs. The locking projections and detent recesses must naturally be disposed according to the wave structure. They must be disposed obliquely in relation to each other, in a manner corresponding to the axial distance between the wave peaks and troughs.

In practice, it is advisable to execute two absolutely identical spool halves so that they can both be injection-moulded as a plastic part using a single tool. In one preferred embodiment, each spool half therefore has both locking projections and detent recesses, which match up in pairs, respectively. Purely to connect the two spool halves, however, it would be sufficient to provide locking projections on one spool half and detent recesses on the other. The invention therefore also includes this type of embodiment.

Aligned with the detent recesses it is preferable to provide spring-loaded tongues which, in the connected position, engage behind the locking projections and prevent the bayonet connection from untwisting. Hence the bayonet connection can only be released when the spring-loaded tongues are pressed out of the locking position.

In the broadest sense, the locking projections can be described as mushroom-shaped in that they have a vertically projecting stem portion and a head that overhangs radially in relation to the stem portion. Accordingly, the detent recesses have an enlarged entry area adjoined in the circumferential direction by a narrower locking portion, behind whose lateral edges the respective heads of the locking projections engage.

A spool according to the invention can be manufactured from injection-moulded plastic in particular, and this process offers the opportunity to mould the spring-loaded tongues directly onto the edge of the detent recesses.

To release the spring-loaded tongues it is preferable to provide sliding pressure elements, which, when moved sufficiently, press the spring-loaded tongues out of their engaged position with the locking projections. Depending on the number of locking projections and detent recesses, these pressure elements can be executed as individual parts or may be mounted on a ring which can be rotated around the rear-facing front surface of the spool parts.

Rear face means the face of each front surface positioned furthest from the locking projections.

BRIEF DESCRIPTION OF THE DRAWINGS

Preferred example embodiments of the invention are described in more detail below with reference to the attached drawings.

DETAILED DESCRIPTION

Figure 1:
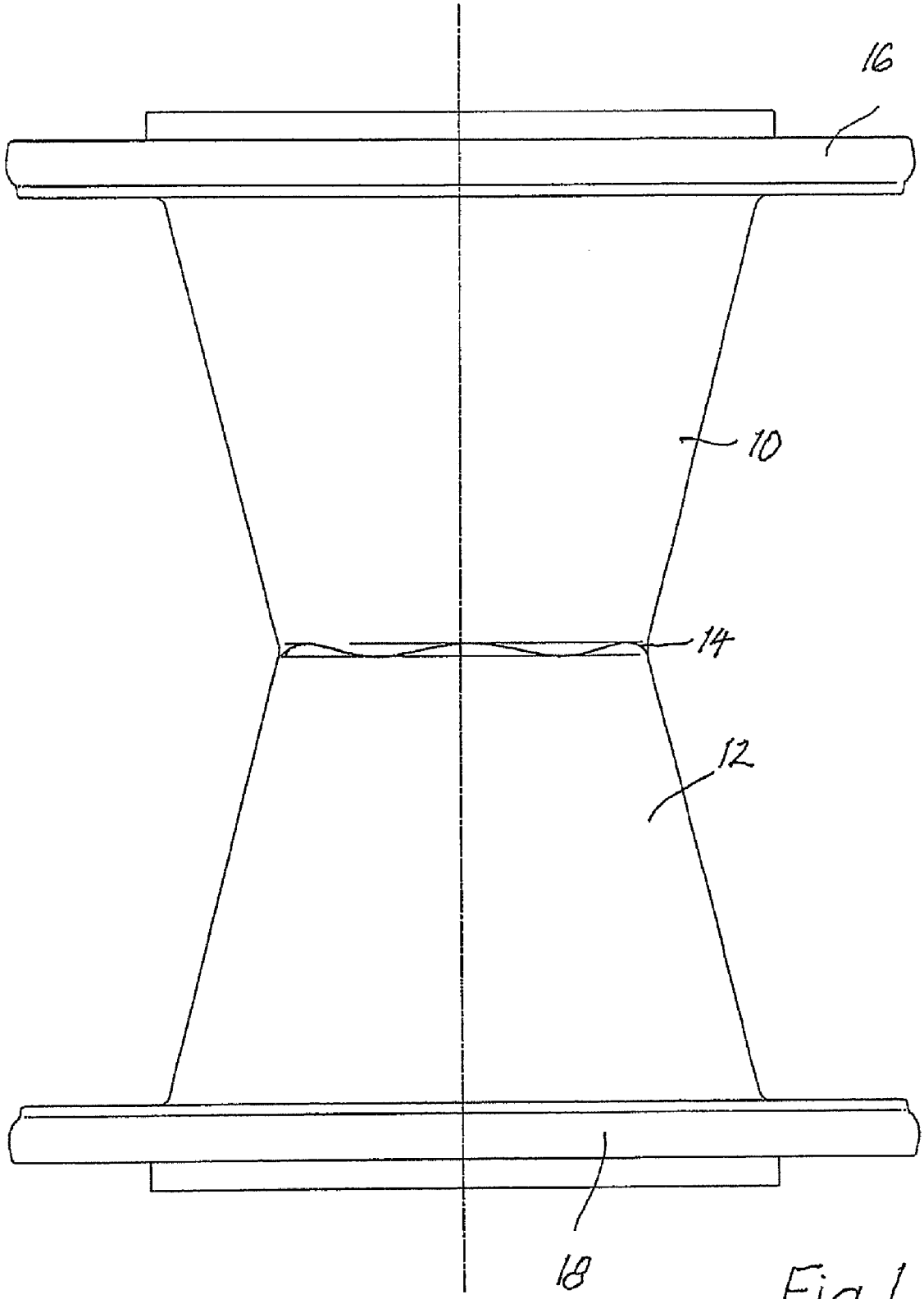
FIG. 1 is a view of a spool with two spool parts, according to the invention.

FIG. 1 shows a spool according to the invention with a first spool part 10 and a second spool part 12, which are coaxially connected to each other. Departing from a central dividing surface 14, where the two spool parts 10, 12 meet up, both spool parts widen conically outwards in a truncated-cone shape to radially projecting flange discs 16, 18 at the outer ends. It is apparent that dividing surface 14 is executed such that a wave-shaped line is visible running around the circumference of the spool as the outer dividing gap.

In the vicinity of dividing surface 14, both spool parts 10, 12 have front surfaces provided at least as circular ring-shaped surfaces. These front surfaces need not feature the wave shape of FIG. 1 across their entire surfaces. Rather, it is sufficient if the outer portion of the two front faces closest to the circumference is wave-shaped so that a wave-shaped gap appears around the circumference.

Figure 2:
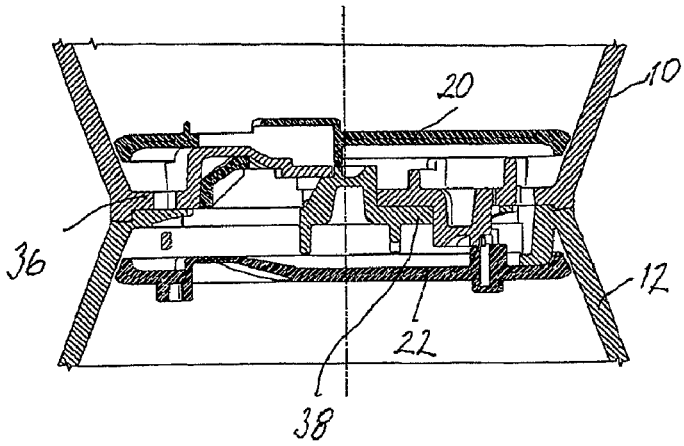
FIG. 2 is a cross-sectional view showing the connection between the two spool parts.

FIG. 2 is a cross-sectional view showing the two inner ends of two connected spool parts 10, 12. The lighter hatching shows the two spool parts 10, 12, whilst the darker hatching denotes two rings which are connected on the inside of the cone to the rear face of the two front surfaces of the spool parts, where they can be rotated. The rings are denoted by 20, 22. The function of the two rings 20, 22 will be described in more detail below in connection with FIGS. 4 and 5.

Figure 3:
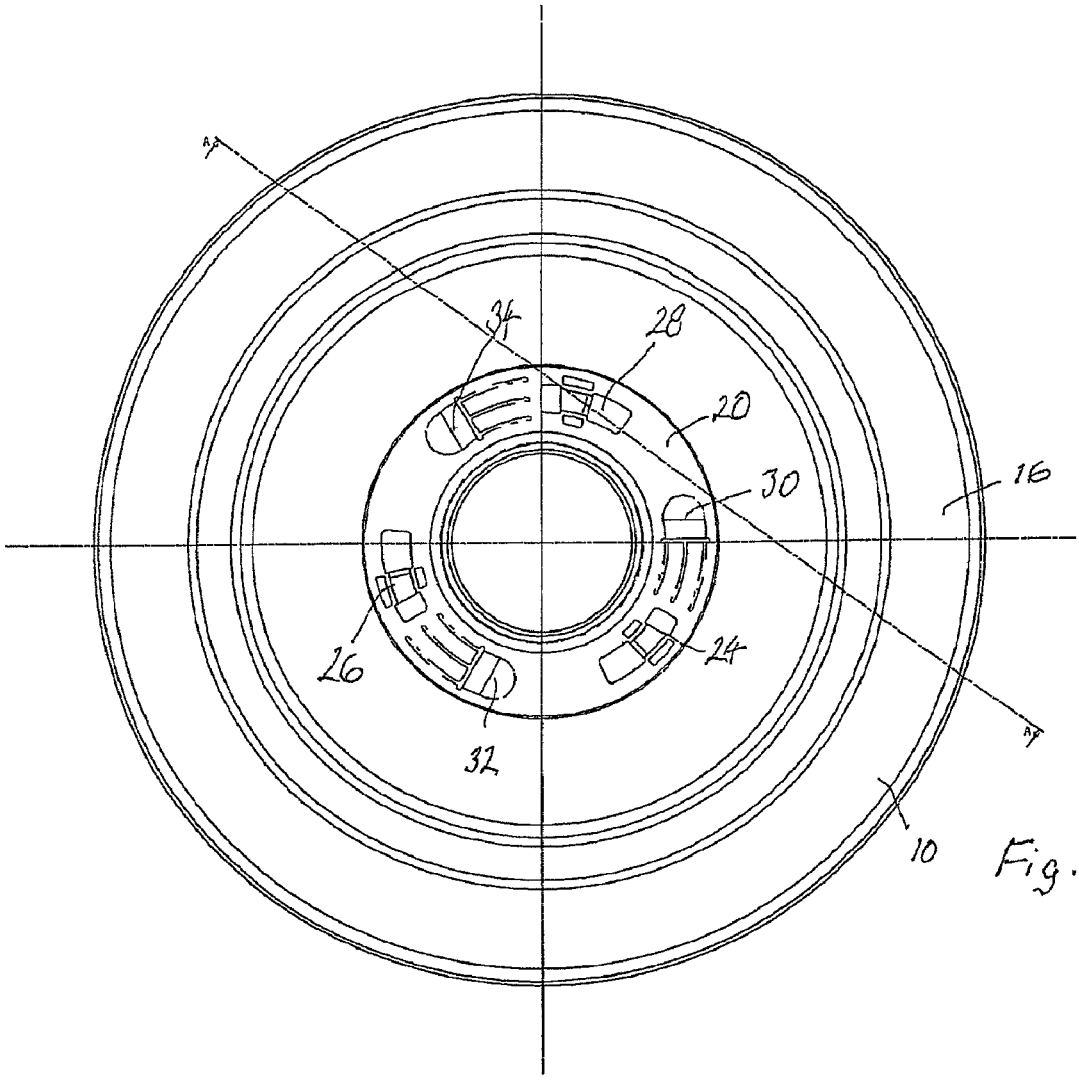
FIG. 3 is a view from the outside of one of the spool parts onto the rear face of the connecting area.

FIG. 3 shows a view into the conical hollow space inside one of spool parts 10, 12. The reader should assume that the part in question is spool part 10. The rotatable ring 20 can be seen in FIG. 3. This ring 20 has openings 24, 26, 28, distributed at an equal distance around the circumference of the ring at an angle of 120°. Aligned with these openings there are recessed grips 30, 32, 34 to accommodate a finger in order to rotate the ring 20 in relation to spool part 10. The distribution of openings 24, 26, 28 and recessed grips 30, 32, 34 coincides with the distribution of the connecting means for connecting two spool parts 10, 12. Reference will additionally be made to FIGS. 4 and 5 in order to explain these connecting means.

Figure 4:
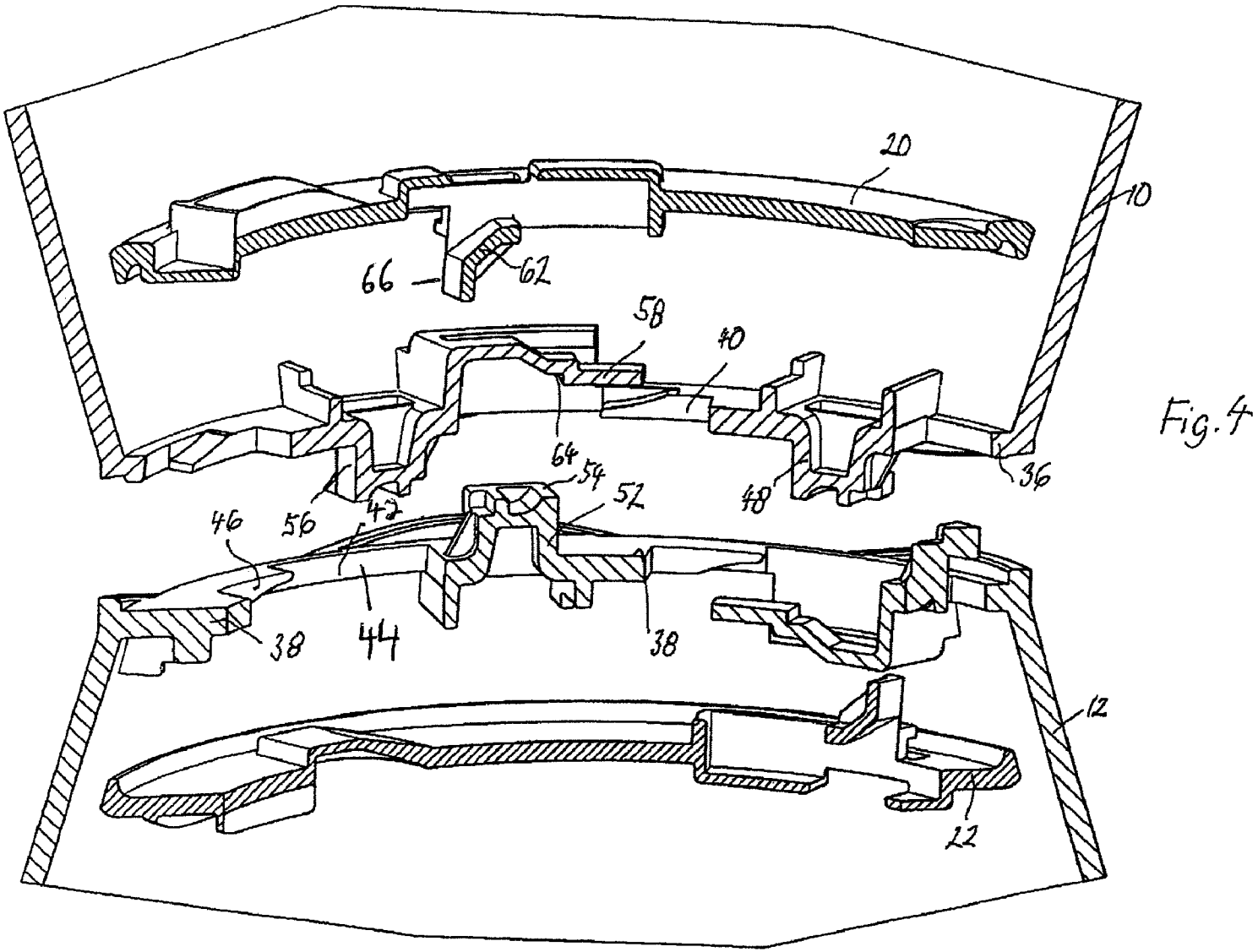
FIG. 4 shows an exploded view of the connection.
Figure 5:
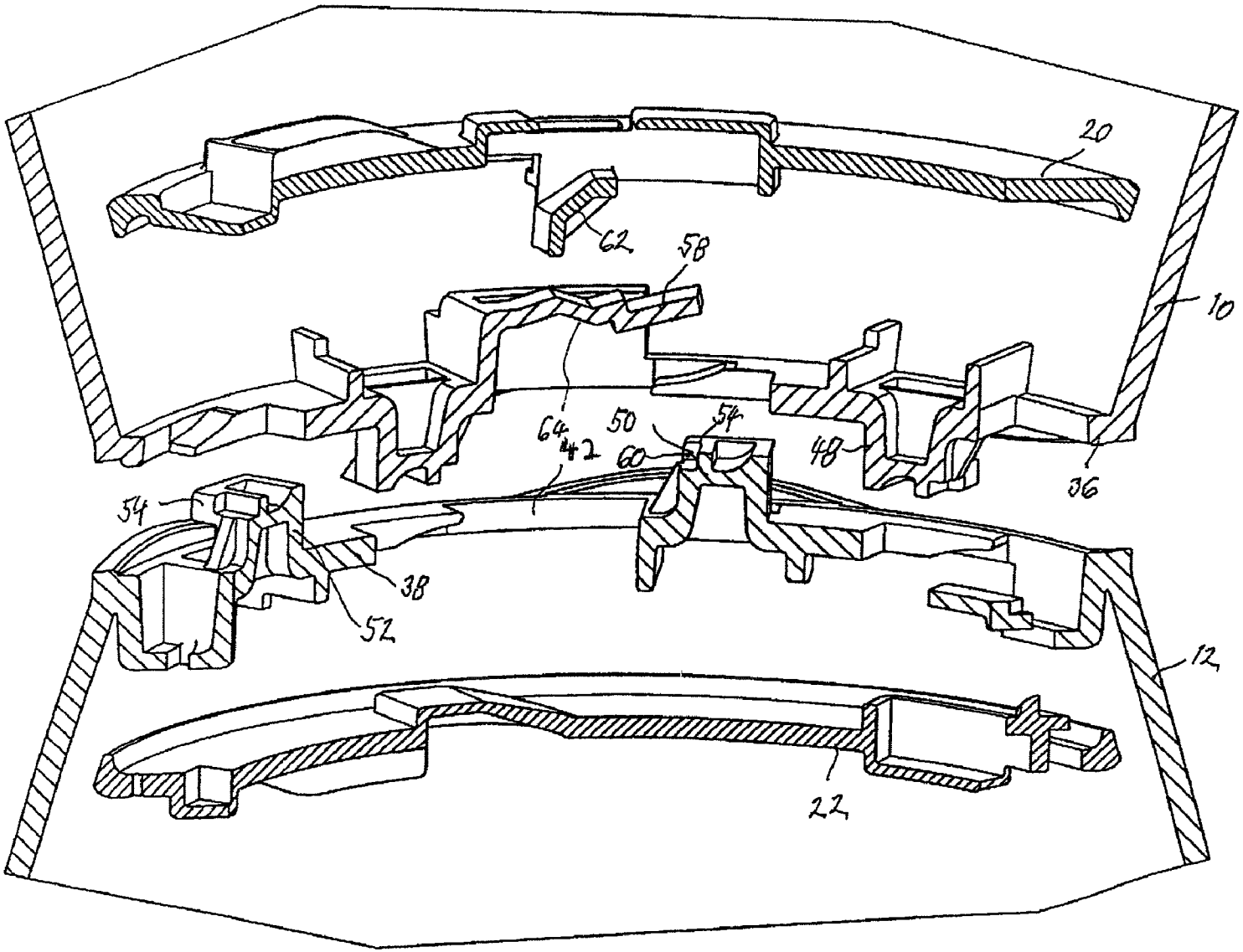
FIG. 5 is the same as FIG. 4, but shows the individual parts in another position.

The connecting means basically comprise, as usual per se, detent recesses in front surfaces 36, 38, in which the locking projections on the other front surface engage, and in which these locking projections can be locked in place by rotating, like a bayonet lock. In FIGS. 4 and 5, the detent recesses are designated on spool part 10 as 40, and on spool part 12 as 42. In one preferred embodiment three detent recesses are distributed around the circumference at an angle of 120°. The locking projections are distributed likewise.

The detent recesses 40, 42 may be described in the broadest sense as keyhole-shaped. They have an enlarged entry area running in the circumferential direction into a narrow, essentially strip-shaped locking section. The entry area is designated in FIG. 4 as 44, the narrower locking section as 46. The locking section is limited on both sides by parts of the front surface executed as sloping surfaces, as will be described in more detail below.

The locking projections may be described in the broadest sense as mushroom-shaped, as they have a narrow stem portion and a head which overhangs the stem portion laterally. The locking projections are designated as 48, 50 in FIGS. 4 and 5. Taking as an example one of the locking projections, designated in FIG. 4 as 56, it can be seen that locking projection 56 comprises a stem 52 which is narrower in the radial direction, and a head 54, which overhangs in the radial direction.

When the two spool parts are joined, locking projections 48, 50, 56 are brought into the enlarged entry areas of detent recesses 40, 42, and when the spool parts are then mutually rotated, heads 54 engage in the narrower locking sections 46. The non-designated sloping surfaces on both sides of the narrower locking sections ensure that the two spool parts are tensioned tightly against each other. The sloping surfaces also serve to compensate for the axial difference in height between the wave peaks and troughs of the front surfaces.

As shown in FIGS. 4 and 5 in the view of the top spool part 10, a spring-loaded tongue 58 is provided adjacent to the entry area of detent recess 40. When locking projections 50 as in FIGS. 4 and 5 are pushed into the enlarged entry area of the detent recesses in the axial direction and the two spool parts 10, 12 are then mutually rotated, the spring-loaded tongue 58 is first pushed up through the head 54 of the locking projections so that the locking projection can enter into the narrower locking section 46. When the locking projection reaches this section, the spring-loaded tongue 58 springs back or downwards in FIG. 5 into the position shown in FIG. 4. In this position, the spring-loaded tongue engages in a recess 60 (FIG. 5) on the rear face of locking projection 50, so that the locking projection cannot be untwisted and the bayonet connection, once established, cannot be released.

To release the bayonet connection the spring-loaded tongue 58 has to be pressed upwards, as shown in FIG. 5, out of recess 60 on the rear face of locking projection 50.

Various types of pressure elements may be provided for this purpose, disposed slidingly on the corresponding spool. According to the invention, rotatable rings 20, 22 are provided for this purpose.

Rings 20, 22 are rotatably attached to the rear or inner faces of front surfaces 36, 38, which, like the two spool parts 10, 12, are executed in identical fashion, so that the text below will refer to the ring 20 for the top spool part 10 shown in FIGS. 4 and 5.

On the underside of ring 20 shown at the top of FIG. 5, there is a pressure element 62, which, once attached to spool part 10, moves beneath spring-loaded tongue 58. On the underside of spring-loaded tongue 58, there is a sloping surface 64. When ring 20 is rotated so that pressure element 62 moves from left to right beneath spring-loaded tongue 58 as shown at the top of FIG. 5, the spring-loaded tongue is lifted into the position shown in FIG. 5, and locking projection 50 can again be twisted in the opening direction of the bayonet connection.

Pressure elements 62 are provided with a projecting coupling part 66 in the direction of the other spool part. When the two spool parts are separated, i.e. when the locking projections are moved out of the narrower locking sections 46 and into the larger entry areas 44 of the locking projections, this coupling part 66 is carried by the locking projections of the other spool part. When the two spool parts 10, 12 are taken apart, rings 20, 22 are thus returned to a position corresponding to the locking position, in which, therefore, the spool parts cannot be taken apart. This position is maintained when the two spool parts 10, 12 are reassembled.

The present description and the following claims are based on the assumption that both front surfaces are provided with corresponding locking projections and detent recesses. Obviously, a connection can be achieved with locking projections on one surface and detent recesses in the other, even though, with this type of solution, the connection between the two spool parts may be less tight.

Hence the dual-surface arrangement of both locking elements—locking projections and detent recesses—as envisaged by the invention—is considered preferable.

There may be openings in the winding core surfaces of the two spool parts 10,12 to allow treatments for the windable product to filter through the latter from the inside of the spool parts, for example warm air to dry the windable product, or a gas or liquid for treating the windable product in some specific way.

What is claimed is:

1. A spool for receiving a wound skein product comprising a rotationally symmetrical spool body with two axial ends provided with flange discs, said spool being divided into two spool parts by a substantially radial dividing surface, these parts having front surfaces running adjacent and parallel to the dividing surface, said front surfaces having locking projections on at least one said front surface and, on another said front surface at least detent recesses which interact with the locking projections of the other spool part, respectively, interlocking therewith in the form of a bayonet catch by mutual rotation of the spool parts, and the front surfaces are constructed such that a dividing line appearing around a spool circumference is wave-shaped having wave peaks and troughs, and wherein the detent recesses and the locking projections are positioned with respect to the wave peaks and wave troughs such that, when rotating the spool parts for closing the bayonet connection, the wave peaks of one of the spool parts are rotated from a position opposite to the wave peaks of the other spool part into a position opposite the wave troughs of the other spool part.

2. The spool of claim 1, wherein the wave-shaped dividing line follows a sinusoidal function.

3. The spool of claim 1, further comprising spring-loaded tongues provided in alignment with the detent recesses, said tongues engaging behind locking projections in a connected position, thereby preventing the bayonet connection from untwisting.

4. The spool of claim 3, wherein the spring-loaded tongues are injection-moulded onto an edge portion adjacent the detent recesses.

5. The spool of claim 3, further comprising sliding pressure elements adapted to press the spring-loaded tongues out of their engagement with the locking projections.

6. The spool of claim 5, wherein the pressure elements are formed on a ring, which is rotatably mounted on a rear face of the front surfaces of the spool parts.

7. The spool of claim 6, wherein the pressure elements are constructed as bridges on recesses provided to receive the spring-loaded tongues.

8. The spool of claim 1, wherein the locking projections comprise stems projecting in an axially parallel manner and, on top of these, radially overhanging heads.

9. The spool of claim 8, wherein the detent recesses comprise entry areas permitting axially-parallel insertion of the locking projections, said entry areas being adjoined by narrower locking sections in the circumferential direction, behind which the heads of the locking projections engage.

10. The spool of claim 9, wherein rear-facing surfaces of the locking projections adjacent to the locking sections slope upwards.

11. The spool of claim 1, wherein the spool parts are made from injection-moulded plastic.

* * * * *